United States Patent [19]

Abplanalp

[11] Patent Number: 5,027,985

[45] Date of Patent: Jul. 2, 1991

[54] AEROSOL VALVE

[76] Inventor: Robert H. Abplanalp, 10 Hewitt Ave., Bronxville, N.Y. 10708

[21] Appl. No.: 385,981

[22] Filed: Jul. 24, 1989

Related U.S. Application Data

[63] Continuation of Ser. No. 275,654, Nov. 21, 1988, abandoned, which is a continuation of Ser. No. 159,468, Feb. 19, 1988, abandoned, which is a continuation of Ser. No. 934,817, Dec. 3, 1986, abandoned.

[51] Int. Cl.[5] ..... B65D 83/00

[52] U.S. Cl. ..... 222/402.1; 222/402.25; 251/353

[58] Field of Search ..... 222/402.1, 402.21, 402.22, 222/402.24, 402.25; 251/353–354

[56] References Cited

U.S. PATENT DOCUMENTS

| | | | |
|---|---|---|---|
| 2,631,814 | 3/1953 | Abplanalp | 251/137 |
| 2,752,066 | 6/1956 | Ayres | 222/41 |
| 2,777,735 | 1/1957 | Green | 299/99 |
| 2,828,892 | 4/1958 | Ward | 222/394 |
| 2,835,417 | 5/1958 | Kiraly | 222/355 |
| 2,837,249 | 6/1958 | Meshberg | 222/394 |
| 2,900,114 | 8/1959 | Utz | 222/394 |
| 2,913,154 | 11/1959 | Kuffer | 222/402.24 X |
| 2,968,428 | 1/1961 | Samuel | 222/394 |
| 2,974,453 | 3/1961 | Meshberg | 53/29 |
| 3,033,473 | 5/1962 | Kitabayashi | 239/579 |
| 3,045,877 | 7/1962 | Green | 222/394 |
| 3,061,203 | 10/1962 | Kitabayashi | 239/337 |
| 3,073,489 | 1/1963 | Friedman | 222/394 |
| 3,074,601 | 1/1963 | Kuffer | 222/394 |
| 3,089,625 | 5/1963 | Sorber et al. | 222/398 |
| 3,098,589 | 7/1963 | Graham | 222/402.22 |
| 3,129,893 | 4/1964 | Green | 239/490 |
| 3,142,420 | 7/1964 | Gawthrop | 222/335 |
| 3,166,250 | 1/1965 | Kappel | 239/337 |
| 3,169,677 | 2/1965 | Focht | 222/394 |
| 3,174,692 | 3/1965 | Green | 239/337 |
| 3,174,694 | 3/1965 | Kitabayashi | 239/573 |
| 3,187,962 | 6/1965 | Meshberg | 222/394 |
| 3,188,008 | 6/1965 | Green | 239/337 |
| 3,206,082 | 9/1965 | Green | 222/394 |
| 3,209,959 | 10/1965 | Green | 222/394 |
| 3,231,153 | 1/1966 | Green et al. | 222/394 |
| 3,233,792 | 2/1966 | Green | 222/394 |
| 3,235,140 | 2/1966 | Green | 222/394 |
| 3,273,606 | 9/1966 | O'Neil, Jr. | 141/3 |
| 3,289,949 | 12/1966 | Roth | 239/579 |
| 3,341,082 | 9/1967 | Meshberg | 222/148 |
| 3,386,479 | 6/1968 | Green et al. | 141/3 |
| 3,455,489 | 7/1969 | Meshberg | 222/94 |
| 3,550,649 | 12/1970 | Meshberg | 141/3 |
| 3,556,171 | 1/1971 | Gangwisch | 141/3 |

(List continued on next page.)

FOREIGN PATENT DOCUMENTS

| | | | |
|---|---|---|---|
| 1244457 | 9/1960 | France | 222/402.24 |
| 1404762 | 5/1965 | France . | |
| 2155033 | 4/1973 | France . | |
| 832507 | 4/1960 | United Kingdom | 222/402.24 |
| 1523732 | 9/1978 | United Kingdom . | |
| 2060080 | 4/1981 | United Kingdom | 222/402.24 |

*Primary Examiner*—Michael S. Huppert
*Assistant Examiner*—Gregory L. Huson
*Attorney, Agent, or Firm*—Davis Hoxie Faithfull & Hapgood

[57] ABSTRACT

In an aerosol valve comprising a mounting cup, a gasket having a central opening, a valve housing, a valve stem and a valve body, where the valve stem and valve body move within the valve housing in response to pressure on the valve stem, the valve body has at least one upstanding wall defining a recess. A slot extending from the top shoulder of the upstanding wall communicates with the interior of the container when the valve is actuated. The valve stem has an orifice aligned with the longitudinal opening of the valve stem which communicates at one end with the slot in the recess of the valve body and at the other end with the orifice in the valve stem. The central opening of the gasket seals the slot defined by the upstanding wall of the valve body when the valve is in a closed position. The valve body also has a shoulder with an annular recess at the base of the upstanding wall.

19 Claims, 4 Drawing Sheets

U.S. PATENT DOCUMENTS

| | | | |
|---|---|---|---|
| 3,583,608 | 6/1971 | Green | 222/402.24 |
| 3,589,571 | 6/1971 | Green | 222/402.24 |
| 3,605,791 | 9/1971 | Troadec | 137/316 |
| 3,606,088 | 9/1971 | Baltzer | 222/94 |
| 3,608,830 | 9/1971 | Ramella | 239/350 |
| 3,612,361 | 10/1971 | Ewald | 222/402.18 |
| 3,613,960 | 10/1971 | Beard | 222/330 |
| 3,627,263 | 12/1971 | Warren et al. | 251/353 |
| 3,653,553 | 4/1972 | Prussin et al. | 222/148 |
| 3,698,453 | 10/1972 | Morane et al. | 141/349 |
| 3,715,081 | 2/1973 | Green | 239/573 |
| 3,741,446 | 6/1973 | Marand | 222/402.24 |
| 3,785,536 | 1/1974 | Graham | 222/402.21 |
| 3,830,412 | 8/1974 | Green | 222/402.24 |
| 3,861,570 | 1/1975 | Green | 222/402 |
| 3,915,390 | 10/1975 | Green | 239/573 |
| 3,942,725 | 3/1976 | Green | 239/468 |
| 4,019,687 | 4/1977 | Green | 239/573 |
| 4,056,213 | 11/1977 | Stern | 222/95 |
| 4,216,884 | 8/1980 | Giuffredi | 222/402.16 |
| 4,390,160 | 6/1983 | Reed | 251/149 |
| 4,393,984 | 7/1983 | Debard | 222/402.18 |
| 4,433,797 | 2/1984 | Galia | 222/207 |
| 4,463,784 | 8/1984 | Butcher et al. | 141/20 |
| 4,471,893 | 9/1984 | Knickerbocker | 222/402 |
| 4,493,444 | 1/1985 | Del Bon et al. | 222/402 |
| 4,513,889 | 4/1985 | Beard | 222/153 |
| 4,532,690 | 8/1985 | Del Bon et al. | 29/451 |

AEROSOL VALVE

This is a continuation of copending application(s) Ser. No. 07/275,654 filed on Nov. 21, 1988, now abandoned.

BACKGROUND OF THE INVENTION

This invention relates to a valve for a pressurized package commonly referred to as an aerosol package.

Aerosol packages usually comprise a valve unit situated in the neck of the container which is opened by finger pressure against an actuator disposed at one terminus of a valve stem. The valve unit has a movable valve body and associated hollow valve stem which unseats from a gasket, thereby permitting flow of product into a hollow valve stem (product conduit).

With certain products, e.g. paints, it is desirable that the valve stem be separable from the valve body in order to clean the product conduit should drying and resultant clogging occur. To provide the aforementioned valve stem removal capability, the valve stem, at one end, is molded integral to the valve actuator to thereby permit its separation from the valve body by pulling on the actuator. At the other end the valve stem mates with a movable valve body situated beneath a resilient gasket, the valve stem being passed through a central opening in the resilient gasket. The gasket seals the product discharge orifice in the valve stem when the valve is in a closed position. By depressing the valve stem, the product orifice in the stem is open to flow of product from the container.

More particularly, the aforedescribed aerosol valve comprises a container closure, commonly called a mounting cup, which is clinched to the container bead. Within and crimped to an upstanding central portion of the mounting cup, commonly called a pedestal, is a valve housing having a resilient gasket disposed atop thereof, which gasket forms a seal between the valve housing and the mounting cup. Disposed within the housing is reciprocable valve closing/opening member comprising a valve body and valve stem, which body and stem have communicating passages for egress of the pressurized product to a discharge orifice situated in a finger depressible actuator.

The aerosol valve described above is commonly referred to in the aerosol industry as a "female" valve, in contrast to the so called "male" valve wherein the valve stem is molded integral to the valve body. U.S. Pat. Nos. 3,033,473, 3,061 203, 3,074,601 and 3,209,960 describe aerosol valves of the "female" type and U.S. Pat. No. 2,631,814 and aerosol valve of the "male" type.

Furthermore, in prior or aerosol valves, the product orifice in the valve stem is formed by a radial pin extending laterally through the wall of the valve stem, a so-called "side action" molding operation. The presence of the "side action" pin necessitates the removal of the pin before ejection of the molded part, with a consequent time delay in the molding operation. Moreover, with orifice sizes commonly used in aerosol valves the "side action" pin often breaks with consequent shutdown of the molding operation.

Additionally, in prior aerosol valves, the central opening of the gasket seals radially against the product orifice in the valve stem. This sealing of the valve stem orifice upon closure of the valve forecloses gravitational return of the product in the hollow valve stem from moving past the valve stem orifice with the often consequent result that residual product in the hollow valve stem drys and clogs the passage in the valve stem.

It is an objective of this invention to provide an aerosol valve that obviates the aforementioned disadvantages of prior art valves.

SUMMARY OF THE INVENTION

Broadly stated, the invention is an improvement in an aerosol valve having a moveable, gasketed valve body-valve stem located within a valve housing, comprising a valve body having at least one upstanding wall defining a recess in the valve body and having a slot through said upstanding wall extending from the top shoulder of the upstanding wall which slot communicates with the interior of the container when the valve is actuated; a valve stem having a longitudinal opening therethrough and a member that frictionally and releasably engages within the valve body recess, said valve stem further having an orifice aligned with the longitudinal opening of the valve stem, which communicates at one end with the slot in the recess of the valve body and at the other end with the orifice in the valve stem; and the central opening of the gasket sealing the slot defined by the upstanding wall of the valve body when the valve is in a closed position.

More specifically, and as a preferred embodiment, the aerosol valve of this invention includes a recess in the valve body beneath the valve stem orifice.

Referring to the drawings.

Figure 5:
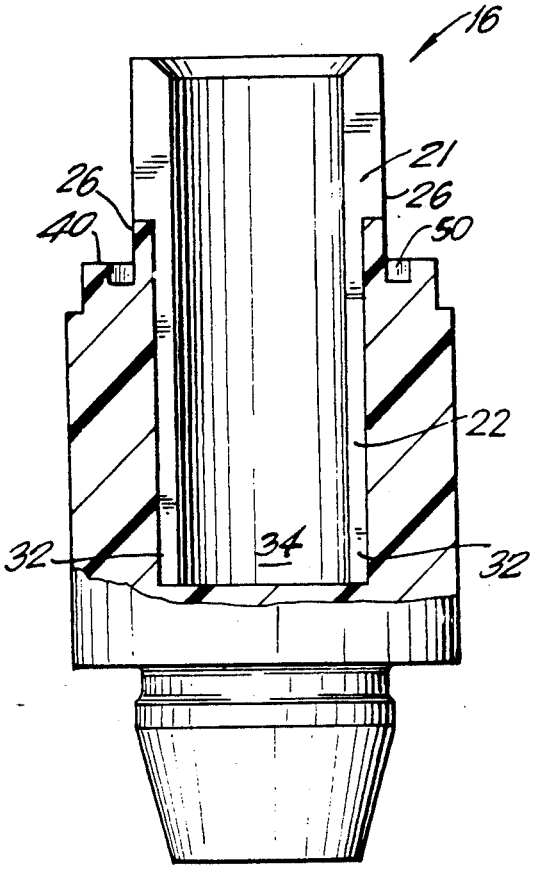
FIG. 5 is an enlarged longitudinal partial section of the valve body of FIGS. 1 and 2.
Figure 4:
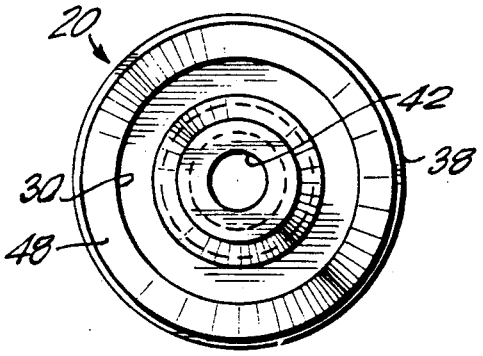
FIG. 4 is a bottom plan view of FIG. 3.
Figure 6:
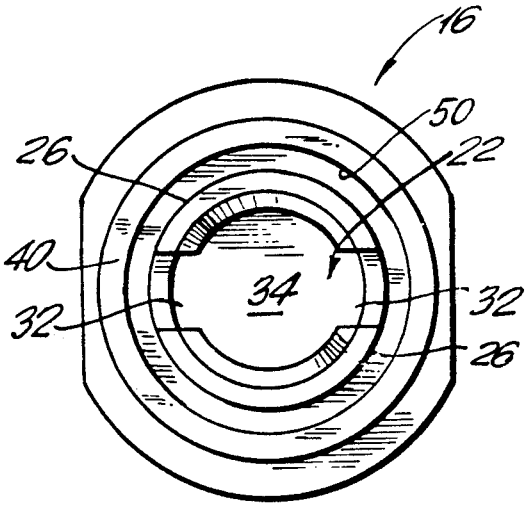
FIG. 6 is a top plan view of FIG. 5.
Figure 8:
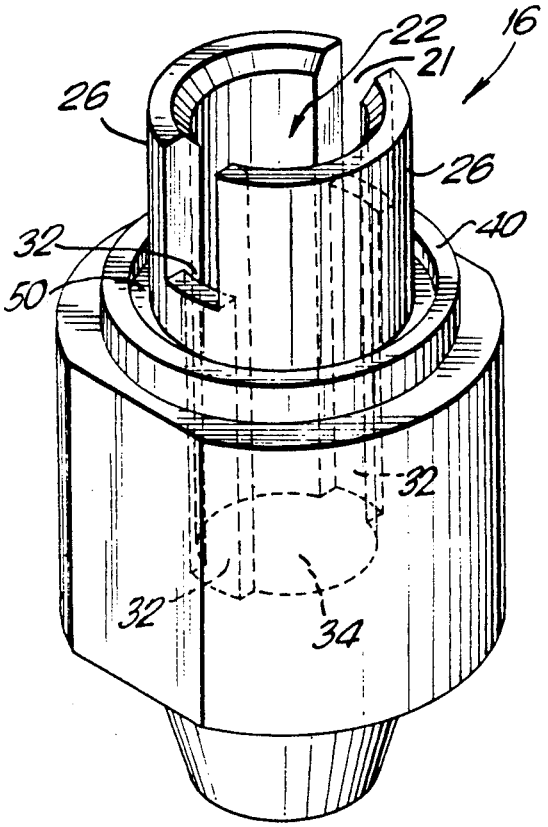
FIG. 8 is a perspective view of the valve body of FIGS. 1, 2, 5–7.

Referring to the drawings, the mounting cup is generally designated as 10. Crimped to the mounting cup 10 is a valve housing 12 and a gasket 14. Disposed within the housing 12 is the valve body 16 having a recess 22, which valve body is biased toward the gasket 14 by the spring 18. A conventional dip tube 46 is shown attached to the bottom of the housing 12. A valve stem, generally designated as 20, is disposed within the recess 22 (shown in greater detail in FIG. 5) in the top of the valve body 16 through the friction fitment of the depending extension 24 of the valve stem 20. The valve stem 20 has longitudinal opening 23. The recess 22 extends from a pair of upstanding arcuate walls 26 (shown in detail in FIG. 8), which form the upper portion of the recess 22 and define a pair of transverse slot 521. Beneath the slot 21, defined by the upstanding arcuate walls 26, are grooves 32 in the side wall of the valve body recess 22, which grooves 32 communicate with the space or reservoir 34 situated in the valve body recess 22 beneath the valve stem 20. An annular recess 50 is disposed in the top shoulder 40 of the valve body 16.

The valve stem 20 has an orifice 42 communicating with the space 34, and the longitudinal opening 23. In the preferred embodiment of the invention, the orifice acts as a product flow control orifice. A recess 30 is formed in the base of the valve stem 20 having a shoulder 28 against which the arcuate walls 26 bottom when the valve body 16 and valve stem 20 are in assembled relation. The outer wall 48 of the recess 30 in the valve stem 20 is tapered.

Actuator button 36 is mounted on the upper portion of the valve stem 20. An annular rib or barb 38 is formed on the valve stem 20, which rib 38 anchors the valve stem 20 to the actuator button 36 and facilitates removal of the valve stem 20 from the valve body 16.

Figure 1:
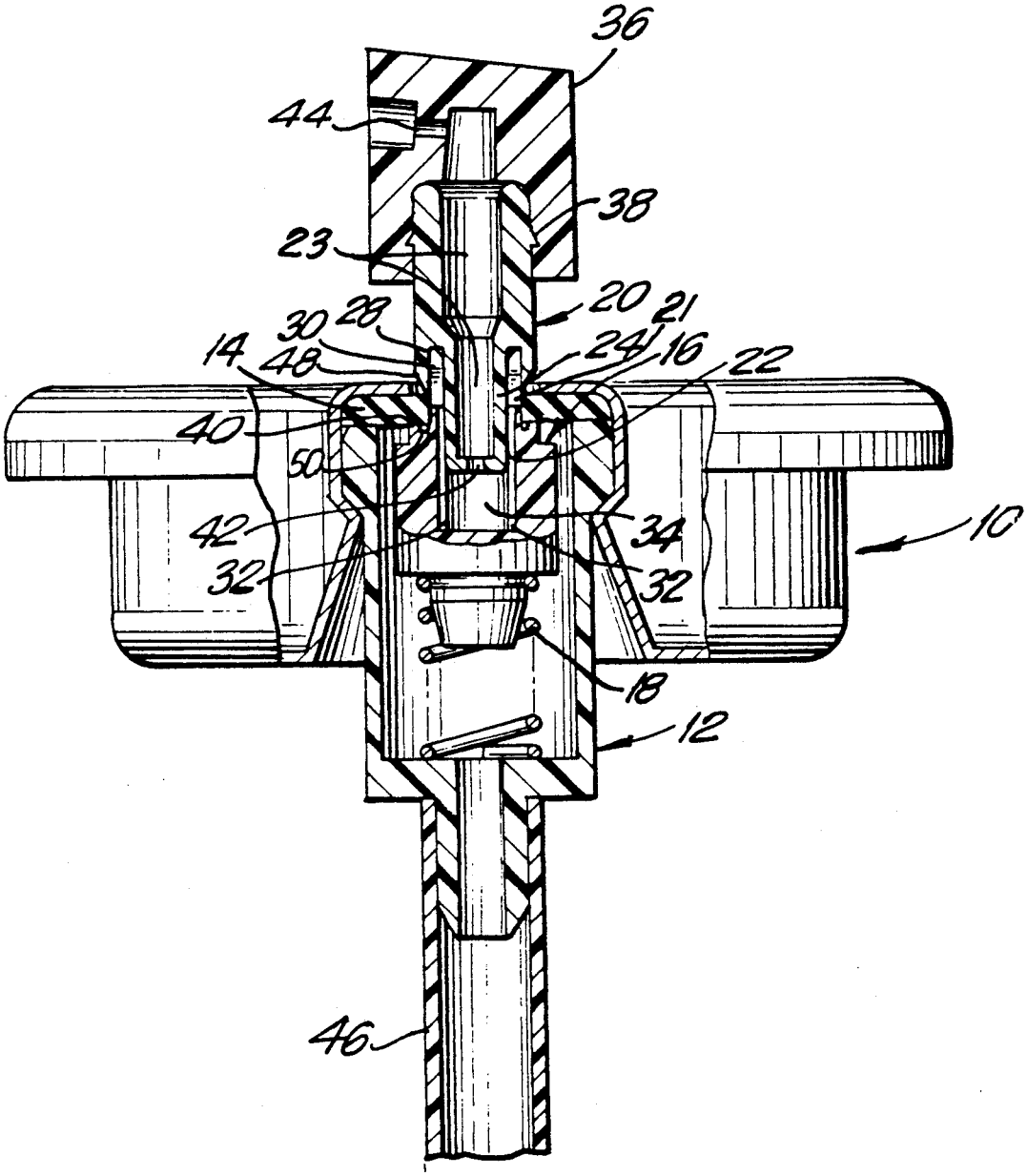
FIG. 1 is a longitudinal sectional view of the valve of this invention in closed position.

In the closed position of the aerosol valve, shown in FIG. 1, the gasket 14 seals against the annular top shoulder 40 of the valve body 16 and the upstanding arcuate walls 26 of the valve body 16 to prevent passage of product through the slot 21.

Figure 2:
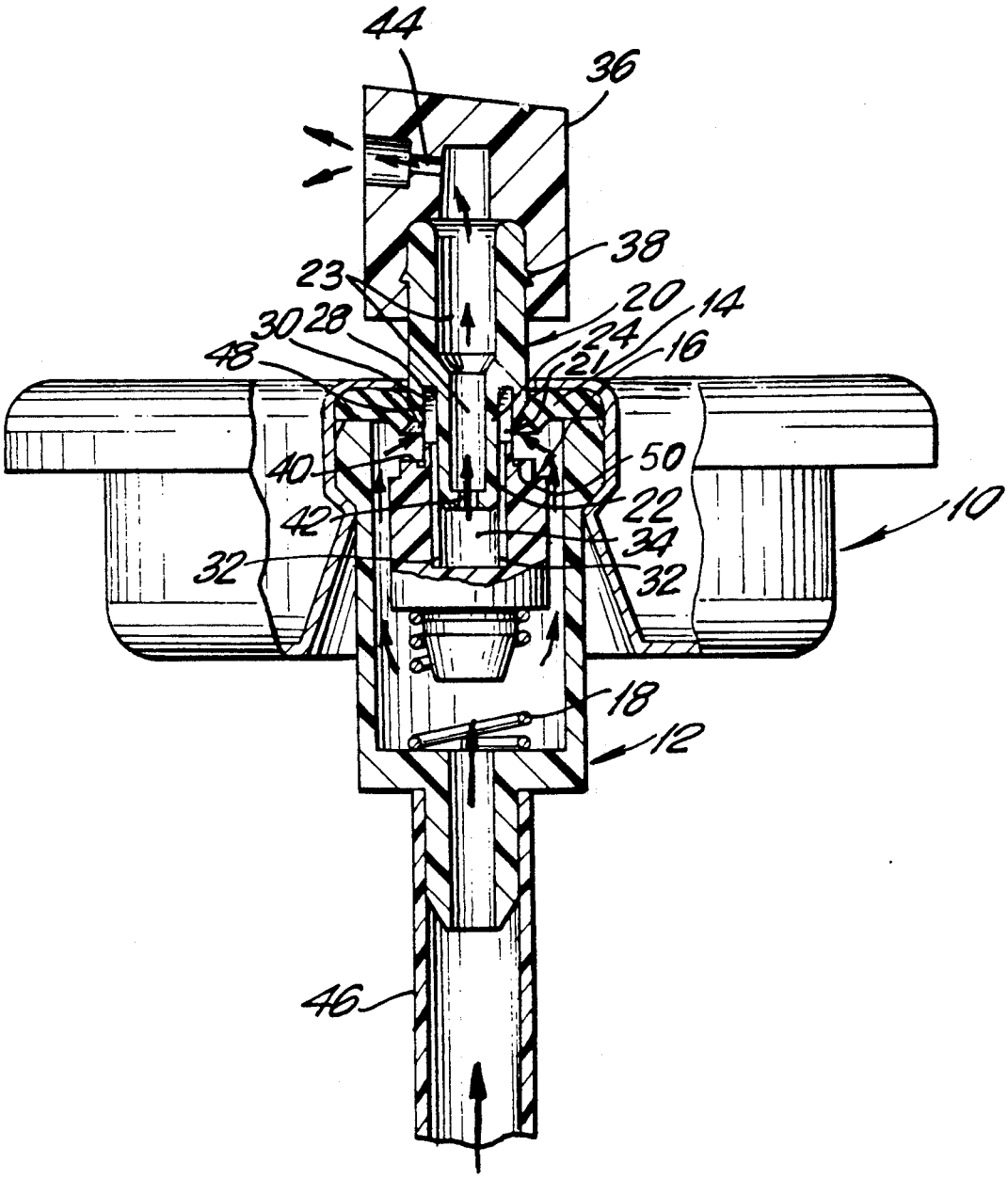
FIG. 2 is a longitudinal section of the valve of this invention in open position.
Figure 3:
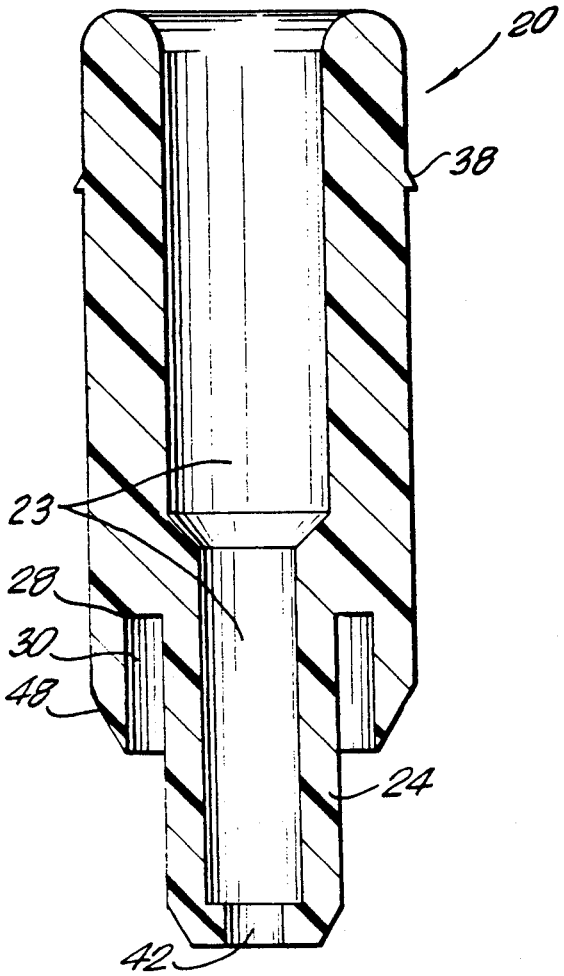
FIG. 3 is an enlarged longitudinal section of the valve stem of FIGS. 1 and 2.

In the open position of the valve, shown in FIG. 2, pressure on the actuator button 36 depresses the valve stem 20 and the valve body 16 to expose the slot 21 to the pressurized contents of the container, thereby permitting passage of the container contents through the slot 21, the grooves 32, the space 34, the orifice 42, the longituidnal opening 23, and then to the discharge orifice 44.

The product passages formed in the valve stem and valve body of the subject invention require no "side action" molding pins. Further disposing the orifice 42 on the discharge side of the space 34 serves the function of permitting product in the valve stem on the discharge side of orifice 42 to back flow into the space 34 and thus not dry and clog the product passage in the valve stem. Still further, disposing the orifice 42 on the discharge side of the space 34 creates a residue of propellant in space 34 upon closing of the aerosol valve, which residue will assist in purging the valve stem and actuator product passages of residual product to thereby avoid or reduce clogging.

In assembling the several valve components, a sub-assembly comprising the valve stem, valve body, spring and gasket is initially made. Such a sub-assembly properly orients and maintains the position of the gasket relative to the valve body, thereby enabling rapid assembly of the sub-assembly and other valve components without risk of dislodging the orientation of the gasket to the other components prior to permanent positioning of the gasket through crimping of the valve to the mounting cup.

Figure 7:
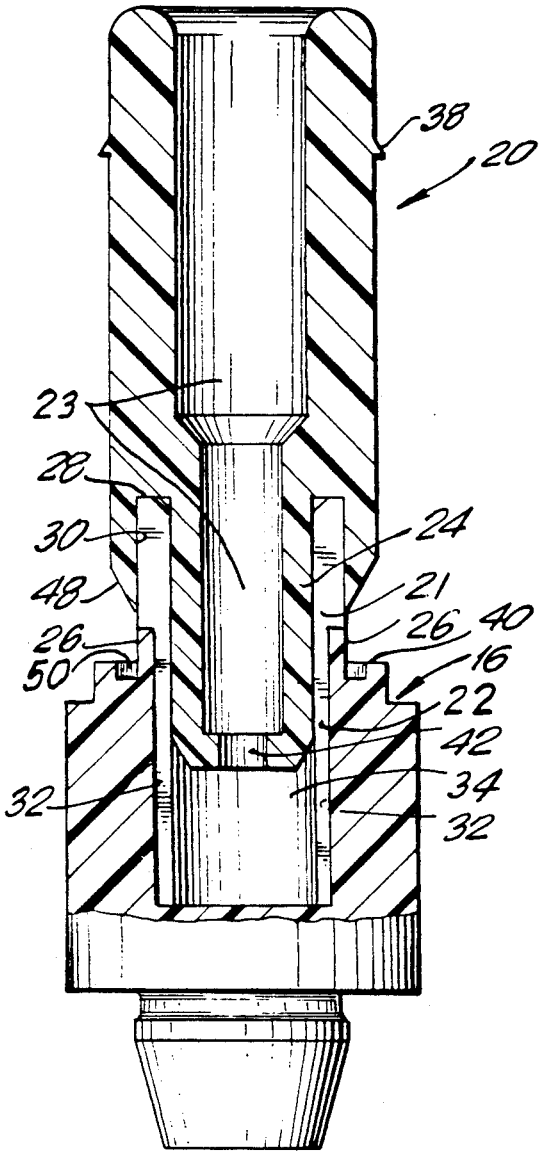
FIG. 7 is an enlarged longitudinal partial section of the valve stem and valve body of FIG. 1.

The structure in the valve stem-valve body fitment portions that facilitates disposition and positional stabilization of the gasket onto the valve body is best shown in FIG. 7. In assembling the valve unit the gasket 14 is passed over the outside surface of valve stem 20 and ultimately seated on the shoulder 40 of the valve body 16. Movement of the gasket 14 to a seating atop shoulder 40 of arcuate walls 26 is facilitated by the sloped shoulder 48 the valve stem 20.

Moreover, the height of the upstanding arcuate walls 26 is preferably greater than the gasket thickness, so as to avoid the top shoulder of the arcuate walls 26 passing beneath the gasket 14 during pressure filling of the container with propellant body.

The structure designation numbers used herein in the description of FIGS. 1 and 2 likewise designate the same structural components in FIGS. 3–8.

I claim:

1. In an aerosol valve unit comprising a mounting cup, a gasket having a central opening, a valve housing, a valve stem and a valve body, wherein the valve stem and valve body move within the valve housing in response to pressure on the valve stem, the improvement comprising;

the valve body having an annular shoulder and at least one upstanding wall extending from the annular shoulder defining a recess in the valve body and having a slot extending from a top shoulder of the upstanding wall partially down the wall, which slot communicates with the interior of the container when the valve is actuated, wherein the annular shoulder has an annular recess;

the valve stem comprising a depending extension that frictionally and releasably engages within the valve body recess, the valve stem and depending extension having a longitudinal opening therethrough and an orifice aligned with the longitudinal opening of the valve stem, the orifice communicating at one end with the slot in the recess of the valve body and at the other end with the longitudinal opening in the valve stem;

and further wherein the central opening of the gasket lies across the annular recess of the annular shoulder of the valve body and against the upstanding wall, sealing the slot defined by the upstanding wall when the valve is in a closed position, the slot extending down the wall to a point above where the gasket engages the wall when the valve is in the closed position.

2. In an aerosol valve unit comprising a mounting cup, a gasket having a central opening, a valve housing, a valve stem and a valve body, wherein the valve stem and valve body move within the valve housing in response to pressure on the valve stem, the improvement comprising the valve body having at least one upstanding wall defining a recess in the valve body and having a slot through said upstanding wall extending from a top shoulder of the upstanding wall which slot communicates with the interior of the container when the valve is actuated; the valve stem comprising a depending extension that frictionally and releasably engages within the valve body recess, said valve stem and depending extension having a longitudinal opening therethrough and an orifice aligned with the longitudinal opening of the valve stem, said orifice communicating at one end with the slot in the recess of the valve body and at the other end with the longitudinal opening in the valve stem; and the central opening of the gasket sealing the slot defined by the upstanding wall of the valve body when the valve is in a closed position.

3. The aerosol valve of claim 2, and further wherein the orifice in the valve stem is the product flow control orifice in the valve body and valve stem.

4. The aerosol valve of claim 2, and further wherein there in a space or reservoir formed between the slot of the valve body and the orifice in the valve stem.

5. The aerosol valve of claim 4, and further wherein the orifice in the valve stem is the product flow control orifice in the valve body and valve stem.

6. The aerosol valve of claim 2, and further comprising arcuate walls defining a pair of transverse slots.

7. The aerosol valve of claim 6, and further wherein the valve stem has a recess for receiving and mating with the arcuate walls of the valve body.

8. The aerosol valve of claim 2, and further wherein the valve stem has a recess for receiving and mating with the upstanding wall of the valve body.

9. The aerosol valve of claim 8, and further wherein the wall defining the recess in the valve stem is tapered downwardly and inwardly toward the valve body.

10. The aerosol valve of claim 2, and further wherein the valve body has an annular shoulder at the bottom of the upstanding wall, wherein the shoulder has an annular recess essentially perpendicular to the wall.

11. The aerosol valve of claim 10 and further wherein the gasket for sealing the slot lies over the annular recess of the shoulder of the valve body when the valve is in a closed position.

12. The aerosol valve unit of claim 2, and further wherein the recess in the valve body extends from the upstanding wall of the valve body, said extended recess having at least one groove which communicates at one end with the slot and at the other end with the orifice in the valve stem.

13. The aerosol valve of claim 12, and further wherein the orifice in the valve stem is the product flow control orifice in the valve body and valve stem.

14. The aerosol valve of claim 12, and further wherein the groove in the valve body is aligned with the slot in the valve body.

15. The aerosol valve of claim 12, and further wherein there is a space of reservoir formed between the extended recess of the valve body and the orifice in the valve stem.

16. The aerosol valve of claim 15, and further wherein the orifice in the valve stem is the product flow control orifice in the valve body and valve stem.

17. The aerosol valve of claim 12, and further wherein said depending extension of the valve stem engages within the extending recess of the valve body.

18. The aerosol valve of claim 17, and further wherein there is a space or reservoir formed between the extended recess of the valve body and the orifice in the valve stem.

19. The aerosol valve of claim 18, and further wherein the groove in the valve body is aligned with the slot in the valve body.

* * * * *